United States Patent [19]

Lillibridge et al.

[11] Patent Number: 4,531,038

[45] Date of Patent: Jul. 23, 1985

[54] RADIO FREQUENCY DIELECTRIC HEATER

[75] Inventors: Harold R. Lillibridge, Burlingame; John Sullivan, San Jose, both of Calif.

[73] Assignee: Champion International Corporation, Stamford, Conn.

[21] Appl. No.: 619,296

[22] Filed: Jun. 11, 1984

[51] Int. Cl.[3] ..... H05B 6/50

[52] U.S. Cl. ..... 219/10.81; 219/10.77

[58] Field of Search ..... 219/10.81, 10.77, 10.75

[56] References Cited

U.S. PATENT DOCUMENTS

| | | | |
|---|---|---|---|
| 2,454,618 | 11/1948 | Stone | 219/10.75 |
| 2,498,760 | 2/1950 | Kreithen | 219/10.77 X |
| 2,661,425 | 12/1953 | Mittelmann | 219/10.77 X |
| 2,705,286 | 3/1955 | Kinn | 219/10.77 |
| 3,551,632 | 12/1970 | Geisel | 219/10.77 X |
| 4,189,685 | 2/1980 | Doss | 219/10.77 X |
| 4,205,210 | 5/1980 | Salway-Waller et al. | 219/10.81 |

*Primary Examiner*—Philip H. Leung

*Attorney, Agent, or Firm*—Evelyn M. Sommer

[57] ABSTRACT

An RF dielectric heater has a variable power output and stable output frequency. A power controller provides variable phase angle control of three-phase AC power. A delta-wye power transformer is coupled between the power controller and a rectifier circuit. The rectifier circuit converts the stepped up, high voltage AC power from the transformer into a DC power output. An RF oscillator circuit driven by the DC power output is coupled to a tank circuit. A load, comprising RF electrodes, create an RF field to heat material passed through the field. The RF electrodes are coupled to the tank circuit in a manner characterized by the absence of any tuning components.

5 Claims, 3 Drawing Figures

POWER SUPPLY
HIGH VOLTAGE RECTIFIER CIRCUIT
CONTROL SECTION CIRCUIT
10
+HV.
74
60
62
54
56
52
50
48
46
44
42
40
20
18
36
38
ELECTROSTATIC SHIELD
PLATE VOLT METER
70
PLATE AMMETER
68
58
RF-ON CKT.
66
64
34
CONTACTOR
T1
T2
T3
32
POWER CONTROLLER AND FILTER
1
2
3
7
VOLTAGE CONTROL POTS
72
72
30
FROM 3Φ 30 AMP CKT. BREAKER

RADIO FREQUENCY DIELECTRIC HEATER

BACKGROUND OF THE INVENTION

The present invention relates to radio frequency ("RF") dielectric heaters, and more particularly to an improved RF dielectric heater which eliminates the need to tune the output circuit when changing the output power.

RF dielectric heaters have been used in the past to provide heat in industrial processes for various purposes, such as drying adhesives on a substrate. In envelope manufacturing, for example, it is necessary to dry the glue which is placed on the envelope flap as envelopes being manufactured travel along a production line. In order to provide desired high rates of throughput, a reliable and efficient heater is required to dry the glue. RF dielectric heaters have been found to be particularly useful for this purpose.

RF heating employs a high frequency varying electric field. The substrate to be heated is placed between a pair metal plates, called electrodes, attached to the output circuit of an RF generator. When high frequency voltage is applied to the electrodes, an alternating electric field is set up between them. As a substrate passes through the field, electrical charges within the molecules of the substrate vibrate in proportion to the frequency of the varying electric field. This intense molecular action generates the heat used for dielectric heating.

Generators used for such dielectric heating are known. For example, such a circuit is shown in Article 665 of the National Electrical Code Handbook, which article deals with induction and dielectric heating. However, such past vacuum-tube generators have required the adjustment of the grid and plate circuits in order to achieve desired changes in the output power of the generator. Such adjusting or "tuning" of the grid and plate circuits results in changes in the output operating frequency. Such frequency shifts are extremely undesirable, in that interference with radio communication systems can result. This is particularly troublesome in the case where fire, police, or other emergency service communication bands are interferred with. It would therefore be advantageous to provide an RF generator, for use in dielectric heating, wherein the output power can be varied as needed for an industrial process without changing the operating frequency of the generator.

The present invention relates to such an improved RF dielectric heater.

SUMMARY OF THE INVENTION

In accordance with the present invention, an improved RF dielectric heater is provided having a variable power output and a stable output frequency. The heater does not require tank circuit tuning. The heater comprises a power controller for providing variable phase angle control of three-phase AC power, together with a delta-wye power transformer. Means are provided for coupling the three-phase output the power controller to the delta input windings of the power transformer. Rectifier circuit means, coupled to the wye output windings of the power transformer, converts three-phase AC power from the transformer to a DC power output. An RF oscillator circuit is provided together with means for coupling the DC output of the rectifier circuit to power the oscillator circuit. A tank circuit is coupled to the output of the RF oscillator. Load electrode means creates an RF field to heat material passed through the field. Circuit coupling means couples the load electrode to the tank circuit, said circuit coupling means being characterized by the absence of any tuning components therein.

The RF dielectric heater can further comprise filter circuit means coupled between the power controller and the power transformer. The filter circuit smooths the output from the power controller, removing high frequency components and therefore enabling the power transformer to operate more efficiently. The power controller can be continuously varied between a 0–100% duty cycle, thereby enabling control of the RF output power without shifting the output frequency from its design value.

DETAILED DESCRIPTION OF A PREFERRED EMBODIMENT

Figure 1:
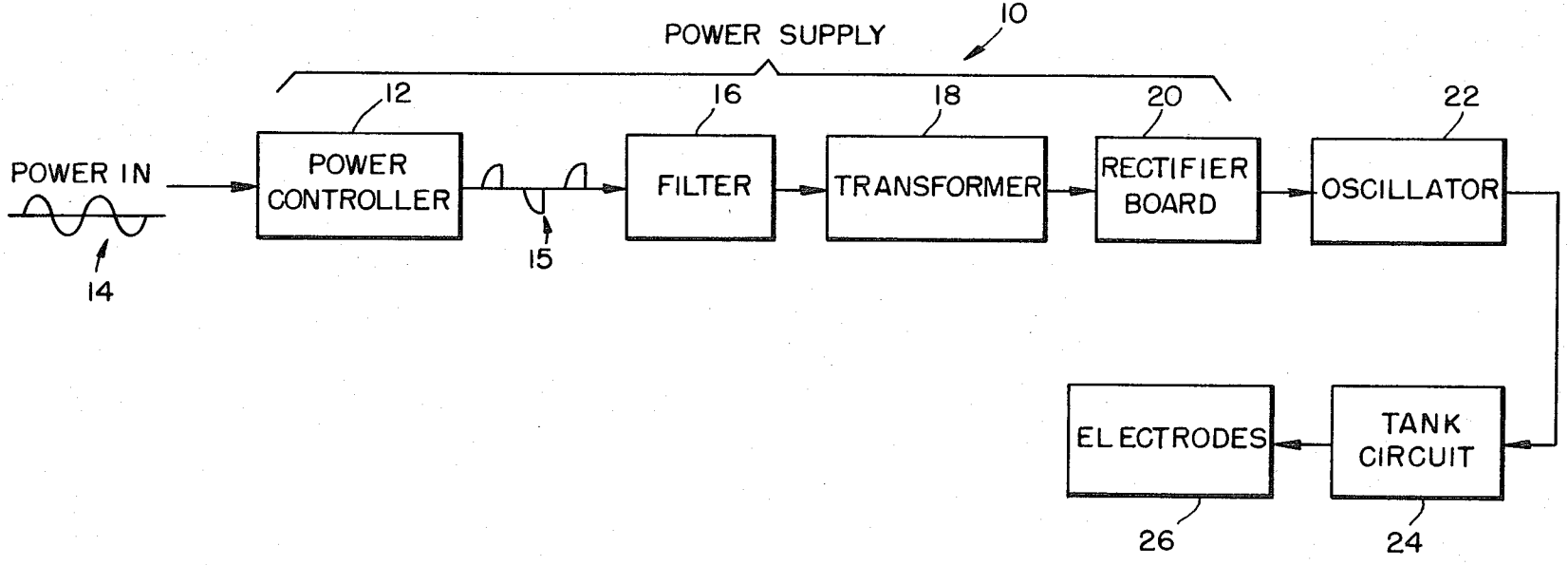
FIG. 1 is an electrical block diagram of the improved RF dielectric heater of the present invention.

As shown in FIG. 1, the present invention comprises an RF dielectric heater having a power supply generally designated 10, an oscillator 22, a tank circuit 24, and electrodes 26. Power supply 10 includes a power controller 12, filter 16, tranformer 18, and rectifier board 20.

Power controller 12 is an SCR power controller which provides solid-state phase angle control of three-phase AC power. The SCRs (thyristors) serve as solid-state switches which, when closed, apply line voltage to the load. In phase angle control, each SCR is turned on for a controlled portion of a half-cycle of the line voltage. In FIG. 1, the input line voltage is a sine wave 14. As shown at 15, the output voltage from power controller 12 is a chopped AC waveform produced by the switching action of the SCRs. The effective output voltage (hence power) is determined by the portion of the line voltage delivered at the output of power controller 12. The load voltage can therefore be varied by selecting the firing time of each SCR. A power controller which can be used for this purpose is that designated as the "Series 441" manufactured by Robicon Corporation, of Pittsburgh, Pa.

Filter 16 is provided at the output controller 12 to smooth the output voltage and remove high frequency components therefrom which could reduce the efficiency of transformer 18. Filter 16 can be a conventional RLC low pass filter (utilizing resistors, inductors, and capacitors) of conventional design or may be a more complex active filter arrangement. Those skilled in the art will appreciate that several different types of conventional filter circuits can be utilized to provide the necessary filtering.

Transformer 18 is a delta-wye power transformer, also of conventional design. Transformer 18 steps up the output voltage from power controller 12 for input to rectifier board 20. Recitifier board 20 comprises high voltage rectifiers to convert the chopped AC output from power controller 12 into a DC power output to drive oscillator 22. Oscillator 22 drives a tank circuit 24 which, in turn, feeds electrodes 26 to produce the desired RF heating.

Figure 2:
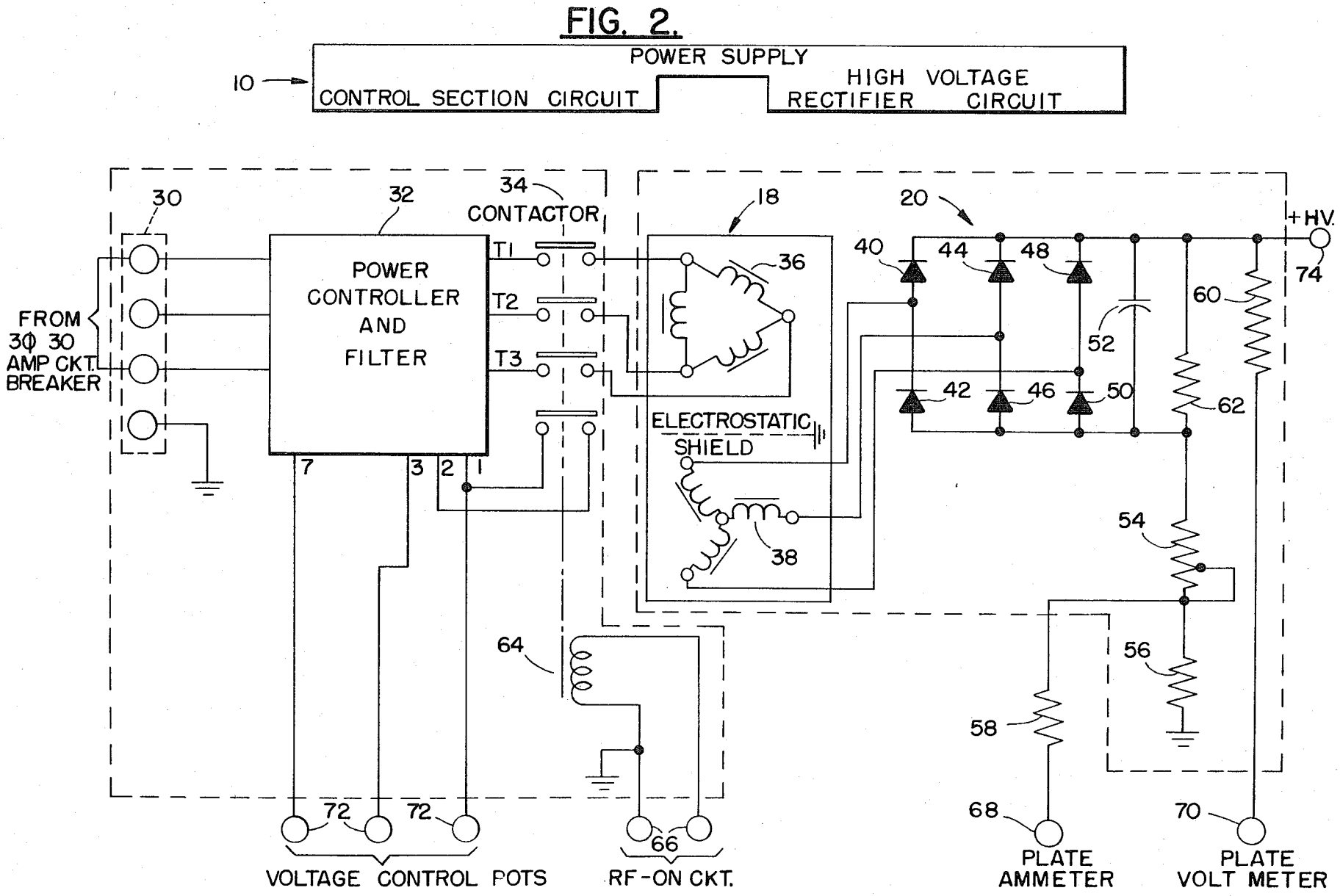
FIG. 2 is a schematic diagram of the power supply for the improved RF dielectric heater.
Figure 3:
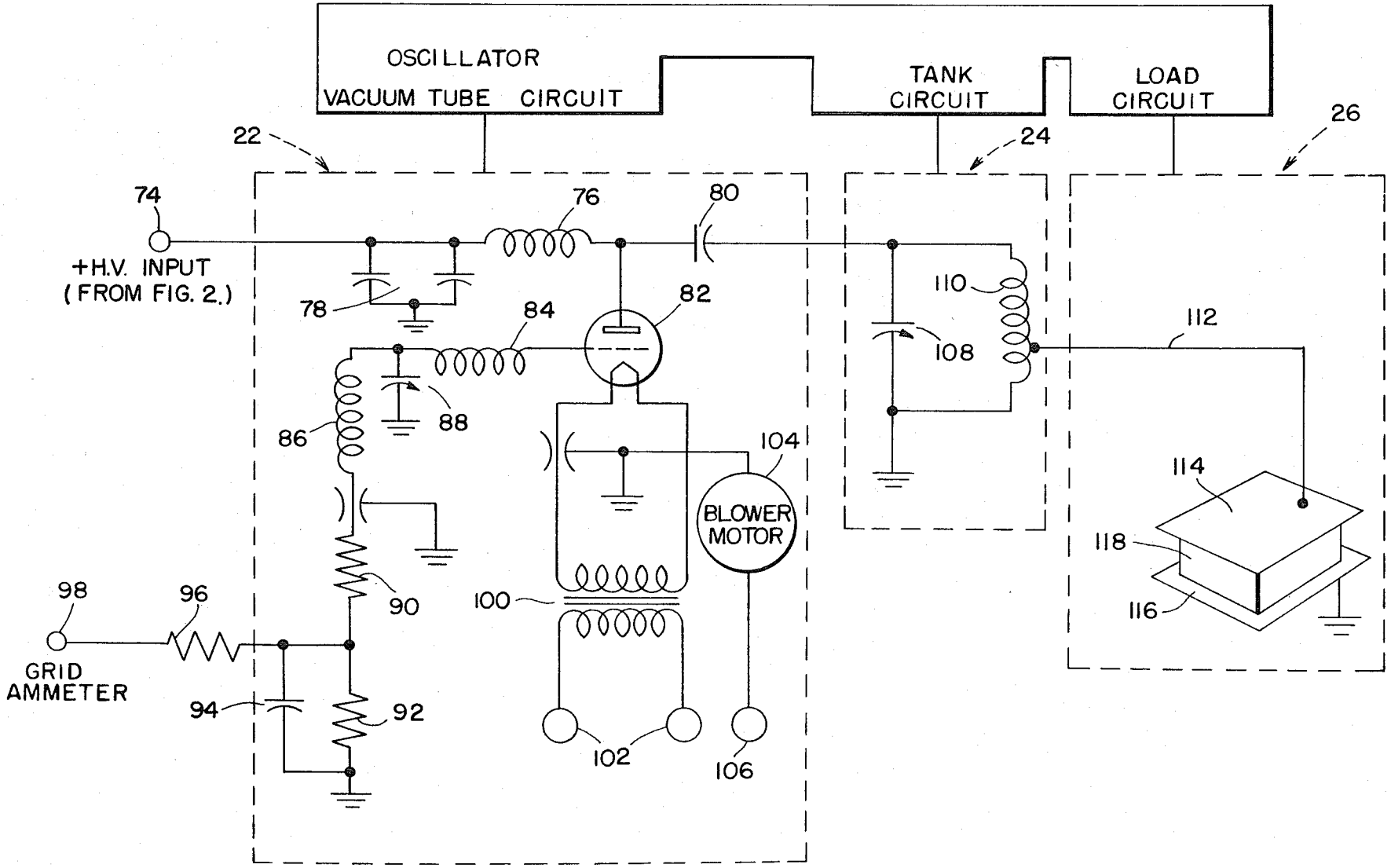
FIG. 3 is a schematic diagram of the oscillator and load circuitry of the dielectric heater.

Turning now to FIGS. 2 and 3, the circuitry show in the block diagram of FIG. 1 will be described in greater detail. FIG. 2 contains the power supply components of the RF dielectric heater. Three-phase AC power from a circuit breaker is input to the system at terminals 30. The three-phase power is then input to power controller and filter unit 32. This unit contains both the power controller 12 and the filter circuit 16 shown in block diagram form in FIG. 1. Potentiometers for controlling the output voltage for each of the three phases output from power controller and filter 32 are coupled to terminals 72. The terminal numbers "1", "2", "3", and "7" depicted on power controller and filter 32 are the terminal designations used by Robicon Corporation on their Series 441 three-phase AC power controller.

Terminals "1" and "2" on power controller and filter 32 are connected together by a contactor 34 when the RF circuit is turned on by actuation of contactor solenoid 64. Solenoid 64 is connected to a source of voltage through a switch (not shown) coupled to terminals 66. Contactor 34, when energized, also couples power output terminals "Tl", "T2" and "T3" of the Robicon power controller 32 to the input delta windings 36 of delta-wye power transformer 18. The output wye windings 38 of transformer 18 are coupled to rectifier circuit 20. Rectifiers 40, 42 convert one phase of the AC output from transformer 18 to a DC voltage. Similarly, rectifiers 44, 46 and 48, 50 convert the other two phases of AC power from transformer 18 to a DC voltage.

The DC voltage output from rectifier circuit 20 is filtered by the network comprising filter capacitor 52 and load resistor 62. The resultant DC output voltage appears on high voltage output terminal 74. This high voltage drives the plate of an oscillator tube 82 shown in FIG. 3. Provision is made, as shown in FIG. 2, for a plate ammeter and plate voltmeter to be connected to the power supply. A voltage divider comprising potentiometer 54 and resistor 56 feeds a current limiting resistor 58 coupled to terminal 68. A plate ammeter can then be connected to terminal 68 for monitoring plate current. Current limiting resistor 60 coupled to the high voltage output of the rectifier circuit 20 feeds a terminal 70, to which a plate voltmeter can be connected.

Turning now to FIG. 3, the high voltage input from terminal 74 is coupled to the plate of oscillator tube 82 through plate choke 76. Choke 76 acts as a filter to any AC component in the high voltage DC output from power supply 10. Plate bypass capacitor network 78 also reduces any AC components by bleeding them to ground. Suppressor choke 84, grid bypass capacitor 88, and grid coil 86 form the grid circuit for oscillator tube 82. A grid ammeter can be connected to terminal 98 for monitoring grid current. Voltage divider resistors 90 and 92, together with shunt capacitor 94 and current limiting resistor 96 are used to drive a grid ammeter coupled to terminal 98. The filament of tube 82 is energized by filament transformer 100, coupled to an AC line voltage (e.g., 120 volts) through terminals 102. A blower motor 104 can be provided for cooling, energized by a voltage coupled to terminal 106. The oscillator circuit thus formed will provide a high voltage, radio frequency oscillation for dielectric heating.

The RF power output from oscillator 22 is coupled, through plate blocking capacitor 80, to tank circuit 24. Tank circuit 24 comprises a simple parallel arrangment of tank coil 110 and tank capacitor 108. Capacitor 108 can be variable, for initial tuning of the dielectric heating system. Once set, capacitor 108 is not varied during the normal operation of the apparatus.

A load circuit comprising electrode assembly 26 is coupled to tank circuit 24. Two parallel electrode plates 114 and 116 are used to set up an RF field thereacross, through which a substrate 118 to be heated, can pass. Electrode plate 116 is coupled to ground. Electrode plate 114 is coupled, via cable 112, directly to tank circuit 24. The arrangement is characterized by the absence of any tuning components in cable 112 which couples tank circuit 24 to electrode assembly 26. Such tuning is not necessary because the load circuit voltage can be adjusted directly by varying the firing time of the SCRs in power controller and filter unit 32 via potentiometers coupled to terminals 72.

It will now be appreciated that the present invention concerns an improved RF dielectric heater which eliminates the need for tank circuit tuning in order to vary the RF output power. To increase or decrease the RF output power across electrode plates 114 and 116, only the load voltage from power controller 12 (FIG. 1) needs to be adjusted. The operating frequency of the dielectric heater (e.g., 27.12 MHz) will not be disturbed when the RF output power is adjusted in this manner.

What is claimed is:

1. An improved RF dielectric heater having an adjustable power output and a stable output frequency comprising:

a power controller for providing a three-phase AC power output with variable phase angle control of such output;

a power transformer having input windings and output windings;

means for coupling the three-phase output of said power controller to the input windings of said power transformer;

rectifier circuit means for converting three-phase AC power input to a DC power output;

means for coupling the output windings of said power transformer to the input of said rectifier circuit means;

an RF oscillator circuit having an input and an output;

means for coupling the DC output of said rectifier circuit to said RF oscillator circuit input to power said oscillator circuit;

a tank circuit coupled to the output of said RF oscillator circuit;

load electrode means for creating a variable RF field in response to and in proportion to the output of said power controller to heat material passed through the field; and circuit coupling means for coupling said load electrode means to said tank circuit, said circuit coupling means being connected directly to said load electrode means, such direct connection being characterized by the absence of any tuning components therein.

2. The RF dielectric heater of claim 1 further comprising filter circuit means coupled between said power controller and said power transformer for smoothin9 the output from said power controller.

3. The dielectric heater of claim 1 wherein the output of said power controller is continuously variable from a 0-100% duty cycle.

4. The dielectric heater of claim 1 wherein said power transformer is a delta-wye transformer.

5. The dielectric heater of claim 4 wherein said power controller is coupled to the delta winding and the rectifier circuit means is coupled to the wye winding of said power transformer.

* * * * *